US011370593B2

(12) United States Patent
Andberg et al.

(10) Patent No.: US 11,370,593 B2
(45) Date of Patent: Jun. 28, 2022

(54) SEGMENTED CONTAINER VOLUME APPARATUS

(71) Applicants: Jaclyn Nicole Andberg, Carpinteria, CA (US); Dorian Jay Simon, Carpinteria, CA (US)

(72) Inventors: Jaclyn Nicole Andberg, Carpinteria, CA (US); Dorian Jay Simon, Carpinteria, CA (US)

( * ) Notice: Subject to any disclaimer, the term of this patent is extended or adjusted under 35 U.S.C. 154(b) by 28 days.

(21) Appl. No.: 16/936,357

(22) Filed: Jul. 22, 2020

(65) Prior Publication Data

US 2021/0024273 A1 Jan. 28, 2021

Related U.S. Application Data

(60) Provisional application No. 62/877,592, filed on Jul. 23, 2019.

(51) Int. Cl.

| | |
|---|---|
| ***B65D 81/32*** | (2006.01) |
| ***B65D 41/02*** | (2006.01) |
| ***B65D 53/00*** | (2006.01) |
| ***B65D 21/02*** | (2006.01) |

(52) U.S. Cl.

CPC ..... *B65D 81/3205* (2013.01); *B65D 21/0228* (2013.01); *B65D 41/02* (2013.01); *B65D 53/00* (2013.01)

(58) Field of Classification Search

CPC ..... B65D 81/3205; B65D 41/02; B65D 41/0478; B65D 41/16; B65D 53/00; B65D 21/0209; B65D 21/0219; B65D 21/0222; B65D 21/0223; B65D 21/023; B65D 21/0028; B65D 47/0895; B65D 2251/0053; B65D 2251/0003; B65D 2251/0015; B65D 2251/0018; B65D 2251/0028; B65D 51/18; B65F 1/1607

See application file for complete search history.

(56) References Cited

U.S. PATENT DOCUMENTS

| | | | | | |
|---|---|---|---|---|---|
| 2,978,142 | A * | 4/1961 | Novick | B65D 21/0219 | 206/508 |
| 3,091,361 | A * | 5/1963 | Gawron | B65D 21/0222 | 206/508 |
| 3,684,123 | A * | 8/1972 | Bridges | B65D 81/3867 | 206/545 |
| 3,811,559 | A * | 5/1974 | Carter | B65D 81/3823 | 220/23.6 |

(Continued)

FOREIGN PATENT DOCUMENTS

| | | | | |
|---|---|---|---|---|
| CH | 675867 A | * | 11/1990 | B65D 1/22 |
| DE | 4229458 A1 | * | 7/1993 | B65D 21/0224 |

(Continued)

*Primary Examiner* — J. Gregory Pickett
*Assistant Examiner* — Abigail Elizabeth Guidry
(74) *Attorney, Agent, or Firm* — Roger A. Jackson

(57) ABSTRACT

An insulated multiple fluid container apparatus having multiple separate volumes that each can have a dedicated removably engagable lid allowing fluid consumption from each of the volumes individually, thus allowing hot and cold fluids to be carried simultaneously. Sealing and insulating as between the multiple separate container volumes is structurally accommodated in the design forming a portable and compact multiple fluid container apparatus.

3 Claims, 14 Drawing Sheets

(56) References Cited

U.S. PATENT DOCUMENTS 5,169,017 A * 12/1992 Cooper ..... B65D 17/404 206/508
5,409,126 A * 4/1995 DeMars ..... B65D 43/0222 206/508
6,575,323 B1 * 6/2003 Martin ..... B65D 47/0852 220/254.2
6,783,018 B1 * 8/2004 Rondeau ..... A01K 97/05 220/325
7,258,255 B2 * 8/2007 Vogel ..... B65D 47/0847 220/254.2
7,913,869 B2 * 3/2011 Cuocolo, Jr. ..... B65D 47/0895 220/717
7,931,166 B2 * 4/2011 Cuocolo, Jr. ..... B65D 47/0895 220/717
8,333,296 B1 * 12/2012 Fung ..... B65D 21/0219 220/666
8,899,435 B1 * 12/2014 Reder ..... A47G 19/2205 220/630
10,512,347 B1 * 12/2019 Shepard ..... B65D 47/066
2004/0118846 A1 * 6/2004 Merolla ..... B65D 47/08 220/254.2
2005/0150803 A1 * 7/2005 Marroncles ..... B65B 43/44 206/499
2006/0054625 A1 * 3/2006 Schwarz ..... B65D 39/16 220/793
2006/0076260 A1 * 4/2006 Luburic ..... B65D 47/0842 206/503
2009/0107998 A1 * 4/2009 Meissen ..... B65F 1/1607 220/254.3
2009/0178940 A1 * 7/2009 Said ..... A61J 9/00 215/11.1
2010/0102057 A1 * 4/2010 Long ..... A01N 1/0263 206/503
2011/0315683 A1 * 12/2011 Macdonald ..... B44D 3/127 220/254.2
2013/0092687 A1 * 4/2013 Ude ..... B65F 1/1607 220/212.5
2013/0264242 A1 * 10/2013 Wojno ..... B65D 21/046 206/509
2014/0326731 A1 * 11/2014 Raymus ..... B65D 51/18 216/6
2015/0021321 A1 * 1/2015 Gosen ..... B65D 21/0204 220/802
2016/0009449 A1 * 1/2016 Su ..... B65D 23/102 206/338
2021/0269236 A1 * 9/2021 Shek ..... B65F 1/1607
2022/0002033 A1 * 1/2022 Braude ..... B65D 25/56

FOREIGN PATENT DOCUMENTS

GB 959005 A * 1/1963 ..... B65D 21/0219
GB 2091538 A * 8/1982 ..... B65D 21/0219
WO WO-0130685 A1 * 5/2001 ..... A01K 7/00
WO WO-2004069674 A2 * 8/2004 ..... B65D 1/42
WO WO-2012059915 A1 * 5/2012 ..... A47G 19/2266
WO WO-2016081949 A2 * 5/2016 ..... B65D 1/24
WO WO-2016157025 A1 * 10/2016 ..... A47J 43/27
WO WO-2017106201 A1 * 6/2017 ..... A45F 3/20

* cited by examiner

SEGMENTED CONTAINER VOLUME APPARATUS

RELATED PATENT APPLICATION

This application claims the benefit of U.S. provisional patent application Ser. No. 62/877,592 filed on Jul. 23, 2019 by Jaclyn Nicole Andberg of Ft. Collins, Colo., U.S. and Dorian Jay Simon of Ft. Collins, Colo., U.S.

TECHNICAL FIELD

The present invention is directed to an apparatus that enhances a user's ability to carry with them and separately consume multiple fluids of any temperature in a single, compact, and portable package that insulates, seals, and separates the multiple fluids from one another.

BACKGROUND OF INVENTION

Similar apparatus are known in the art being manufactured by Hydroflask, Yeti, H2Joe, Golchi, and the like, in the field of portable and compact beverage containers, with some having multiple separate volume beverage containers being used for hiking, camping, fishing, travel, and so on.

In U.S. Pat. No. 8,091,730 to Keefe et al., disclosed is a spill resistant drinking vessel with lid and special valve to help prevent spilling of the beverage inside when the vessel is tipped over, via using a check type valve to restrict flow in a tip over of the vessel, however, to allow the valve to flow when the cover spout was sucked on by the user, see FIGS. 3A and 3B.

In U.S. Pat. No. 8,870,010 to Buck disclosed is a cup lid with integrated container having optionally multiple volumes that are stackable and nested to one another, see FIGS. 12A, 12B, 12C, 12D, 12E, 13, and 15 for typical examples, however, no insulating, or specific fluid sealing is taught.

In U.S. Pat. No. 10,421,595 to Wondka disclosed is a multi-compartment cup for holding a wet compartment for a beverage and a dry compartment for a snack, also to have structure to separately dispense from each compartment, i.e. having wet and dry compartments for specific applications, see FIGS. 1 and 7 in particular, and also see FIGS. 26, 31, and 32.

In United States patent application publication number 2017/0349354 to Garg (assigned to Golchi) disclosed is a multiple housing vacuum insulated canister to store multiple liquids at once. The canister includes a first housing, a second housing, a third housing, a first turning lid, and a second turning lid. The first housing stores a first liquid using the first lid, with the second housing storing solid items, with the first and second housings in a vertically (stacked) attached arrangement. Further a third housing can be employed using the second lid that stores a second liquid attaching vertically to the second housing.

In United States patent application publication 2010/0200438 to Davies discloses a modular container system resulting in a set of interconnected container spaces that are vertically stacked and screwed together in a form close to a water bottle in size, see FIGS. 1 and 2, wherein no specific items were slated to be stored in the container as it was a general use container without openings in the end lids, although the interior compartments could be separate or interconnected.

What is needed is an apparatus that allows the user to carry with them and separately consume multiple fluids in separate volumes of any temperature in a single, compact, and portable package that insulates, seals, and separates the multiple fluids from one another. An additional desirable feature would be to facilitate selectable inter communication as between the multiple volumes to allow a larger volume of fewer different fluids to be carried and consumed by the user.

SUMMARY OF INVENTION

Broadly, the present invention is a segmented longwise volume container apparatus that includes a base, a surrounding sidewall extending from the base, the surrounding sidewall being about a first lengthwise axis, the surrounding sidewall having a first end portion and an opposing second end portion with the first lengthwise axis spanning therebetween, the surrounding sidewall also including an outer surface and an opposing inner surface, wherein the second end portion is adjacent to the base, the surrounding sidewall terminating at the first end portion in a first margin, the base and the inner surface defining the surrounding sidewall interior.

Further included is a partition disposed within the surrounding sidewall interior, the partition having a primary partial outer perimeter that is affixed to a portion of the inner surface, the partition having a secondary partial outer perimeter that extends apart from the inner surface forming the secondary margin, wherein the partition forms a plurality of separate volumes within the surrounding sidewall interior.

In addition included is a lid apparatus including an exterior portion and an opposing internal portion, the internal portion is removably engagable to the first margin and the secondary margin, the lid apparatus also including the first aperture therethrough between the exterior portion and the internal portion.

These and other objects of the present invention will become more readily appreciated and understood from a consideration of the following detailed description of the exemplary embodiments of the present invention when taken together with the accompanying drawings, in which;

BRIEF DESCRIPTION OF DRAWINGS

FIG. 3 shows plan view 3-3 from FIG. 1, wherein FIG. 3 shows in particular the first and second lid apparatus both in the closed operational state that includes the hinge, and the first and second removably engagable covers;

FIG. 4 shows plan view 4-4 from FIG. 1, wherein FIG. 4 shows the primary base and primary surrounding sidewall;

FIG. 5 shows section view 5-5 from FIG. 1, wherein FIG. 5 shows the primary base, the primary surrounding sidewall, the primary interior, plus the inner and outer surfaces of the primary surrounding sidewall;

FIG. 6 shows section view 6-6 from FIG. 1, wherein FIG. 6 shows the primary cap, the primary cap aperture, and the primary cap plug;

FIG. 7 shows section view 7-7 from FIG. 1, wherein FIG. 7 shows the secondary surrounding sidewall, the secondary base, the secondary base aperture, and the secondary base plug;

REFERENCE NUMBERS IN DRAWINGS

Figure 1:
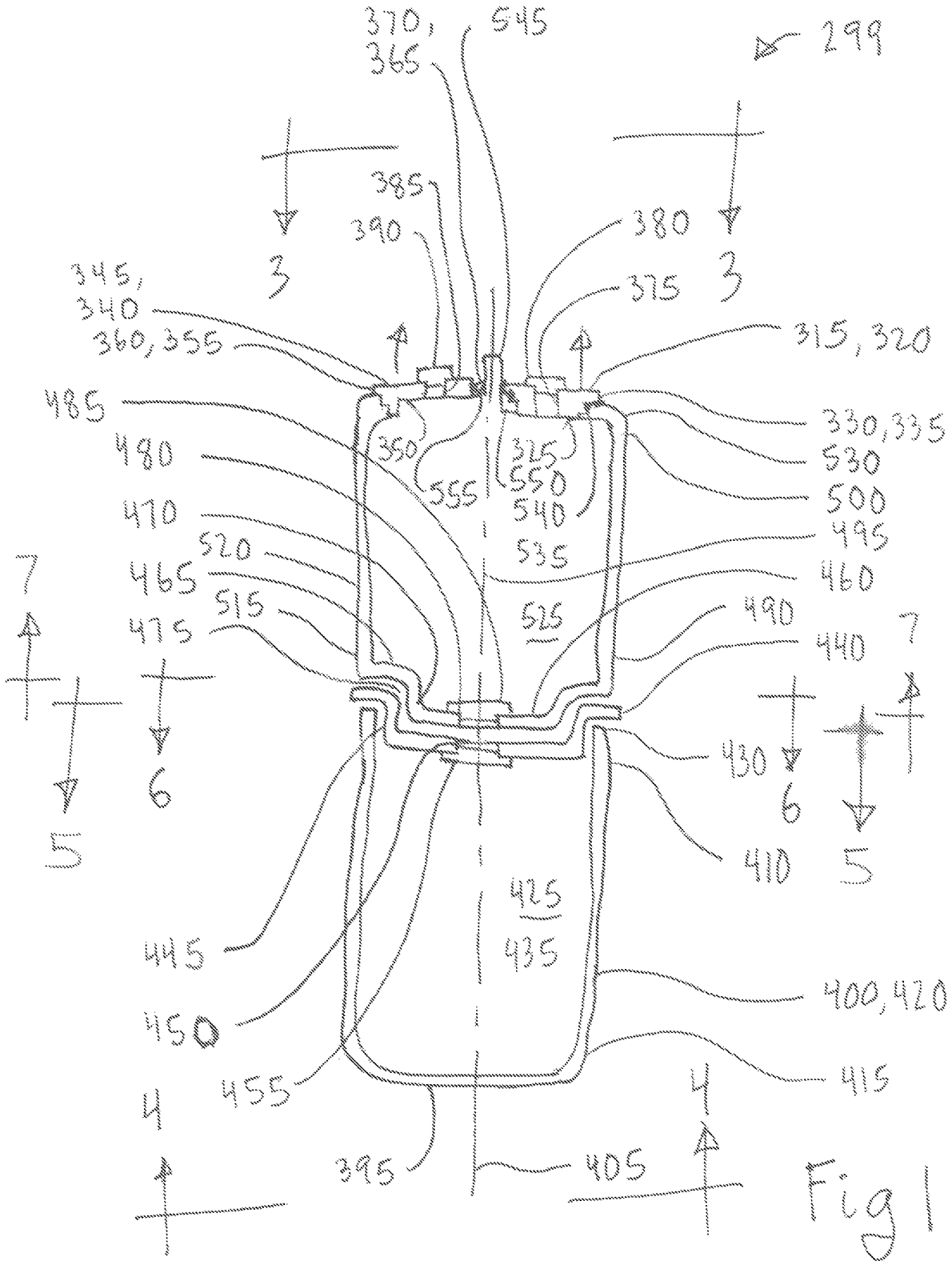
FIG. 1 shows a cross section of the segmented shortwise volume container apparatus that includes the primary base, the primary and secondary surrounding sidewalls, plus the primary cap, secondary base, the secondary beam, with the first and second lid apparatus both in the closed operational state.

50 Segmented Longwise Volume Container Apparatus
55 Base
60 Surrounding sidewall
65 First lengthwise axis of the surrounding sidewall 60
70 First end portion of the surrounding sidewall 60
75 Second end portion of the surrounding sidewall 60
80 Outer surface of the surrounding sidewall 60
85 Inner surface of the surrounding sidewall 60
90 First margin of the surrounding sidewall 60
95 Interior of the surrounding sidewall 60
100 Partition
105 Primary partial outer perimeter of the partition 100
110 Affixed portion of the primary partial outer perimeter 105
115 Secondary partial outer perimeter of the partition 100
120 Secondary margin of the partition 100
125 Plurality of separate volumes within the surrounding sidewall 60 interior 95
135 Lid apparatus
140 Exterior portion of the lid apparatus 135
145 Internal portion of the lid apparatus 135
150 Removable engagement of the internal portion 145 to the first margin 90 and the secondary margin 120
155 First aperture of the lid apparatus 135
160 First sealing element
165 First open state of the first sealing element 160
170 First closed state of the first sealing element 160
175 First sealing structure
180 First retention means for first sealing element 160
185 Second retention means for first sealing element 160
190 Second aperture
195 First pivotal attachment of the first sealing element 160
200 First elastomeric element of the first sealing element 160
205 Third retention means of the first sealing element 160
210 Fourth retention means of the first sealing element 160
215 First hinge element of the of the first sealing element 160
220 Second elastomeric element of the first sealing element 160
225 Fifth retention means of the first sealing element 160
230 Sixth retention means of the exterior portion 140
235 Third elastomeric element of the first sealing element 160
299 Segmented Shortwise Volume Container Apparatus
300 Sidewall nesting step
305 Partition nesting step
310 Partition hinge
315 First lid apparatus
320 First exterior portion of the first lid apparatus 315
325 First internal portion of the first lid apparatus 315
330 First outer periphery portion of the first lid apparatus 315
335 First nested step of first the lid apparatus 315
340 Second lid apparatus
345 Second exterior portion of the second lid apparatus 340
350 Second internal portion of the second lid apparatus 340
355 Second outer periphery portion of the second lid apparatus 340
360 Second nested step of the second lid apparatus 340
365 Second hinge of the second outer periphery portion 355
370 Pivotal engagement of the second hinge 365 to the partition hinge 310
375 Primary aperture of the first lid apparatus 315
380 First removably engagable cover of the first lid apparatus 315
385 Secondary aperture of the second lid apparatus 340
390 Second removably engagable cover of the second lid apparatus 340
395 Primary base
400 Primary surrounding sidewall
405 Primary lengthwise axis of the primary surrounding sidewall 400
410 Primary first end portion of the primary surrounding sidewall 400
415 Primary second end portion of the primary surrounding sidewall 400
420 Primary outer surface of the primary surrounding sidewall 400
425 Primary inner surface of the primary surrounding sidewall 400
430 Primary first margin of the primary surrounding sidewall 400
435 Primary interior of the primary surrounding sidewall 400
440 Primary cap
445 Stepped outer periphery of the primary cap 440
450 Primary cap aperture

455 Plug of the primary cap aperture
460 Secondary base
465 Secondary outer periphery portion of the secondary base 460
470 Secondary shoulder portion of the secondary base 460
475 Removable engagement of the secondary shoulder portion 470 to the stepped cap outer periphery 445
480 Secondary base aperture
485 Plug of the secondary base aperture of the secondary base aperture 480
490 Secondary surrounding sidewall
495 Secondary lengthwise axis of the secondary surrounding sidewall 490
500 Secondary first end portion of the secondary surrounding sidewall 490
515 Secondary second end portion of the secondary surrounding sidewall 490
520 Secondary outer surface of the secondary surrounding sidewall 490
525 Secondary inner surface of the secondary surrounding sidewall 490
530 Secondary first margin of the secondary surrounding sidewall 490
535 Secondary interior of the secondary surrounding sidewall 490
540 Secondary sidewall nesting step of the secondary first margin 530
545 Secondary beam
550 Secondary beam nesting step
555 Secondary beam hinge

DETAILED DESCRIPTION

With initial reference to FIG. 1 shown is the cross section of the segmented shortwise volume container apparatus 299 that includes the primary base 395, the primary 400 and secondary 490 surrounding sidewalls, plus the primary cap 440, secondary base 460, the secondary beam 545, with the first 315 and second 340 lid apparatus both in the closed operational state.

Figure 2:
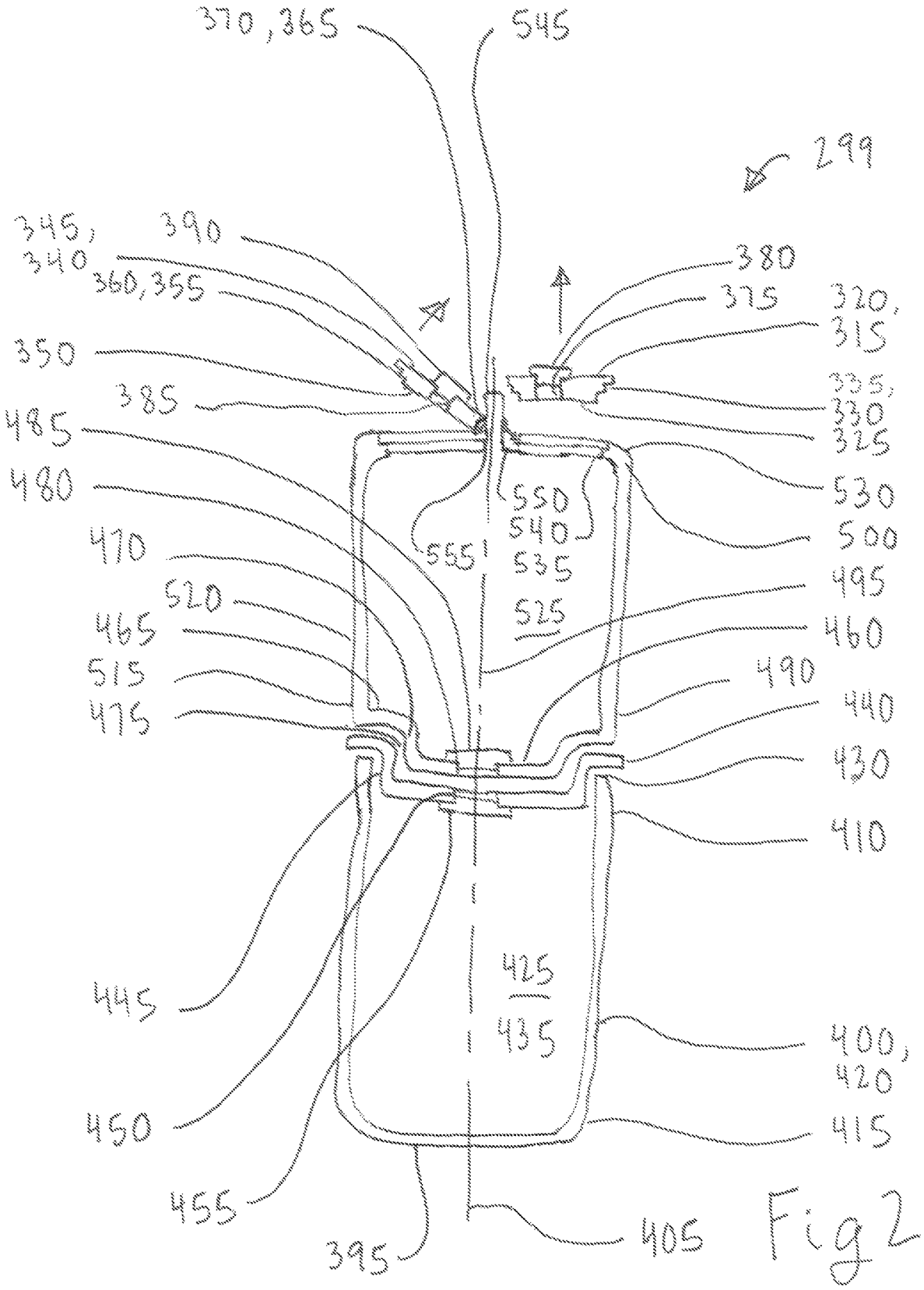
FIG. 2 shows a cross section of the segmented shortwise volume container apparatus that includes the primary base, the primary and secondary surrounding sidewalls, plus the primary cap, secondary base, the secondary beam, with the first and second lid apparatus both in the open operational state.

Next, FIG. 2 shows a cross section of the segmented shortwise volume container apparatus 299 that includes the primary base 395, the primary 400 and secondary 490 surrounding sidewalls, plus the primary cap 440, secondary base 460, the secondary beam 545, with the first 315 and second 340 lid apparatus both in the open operational state.

Figure 3:
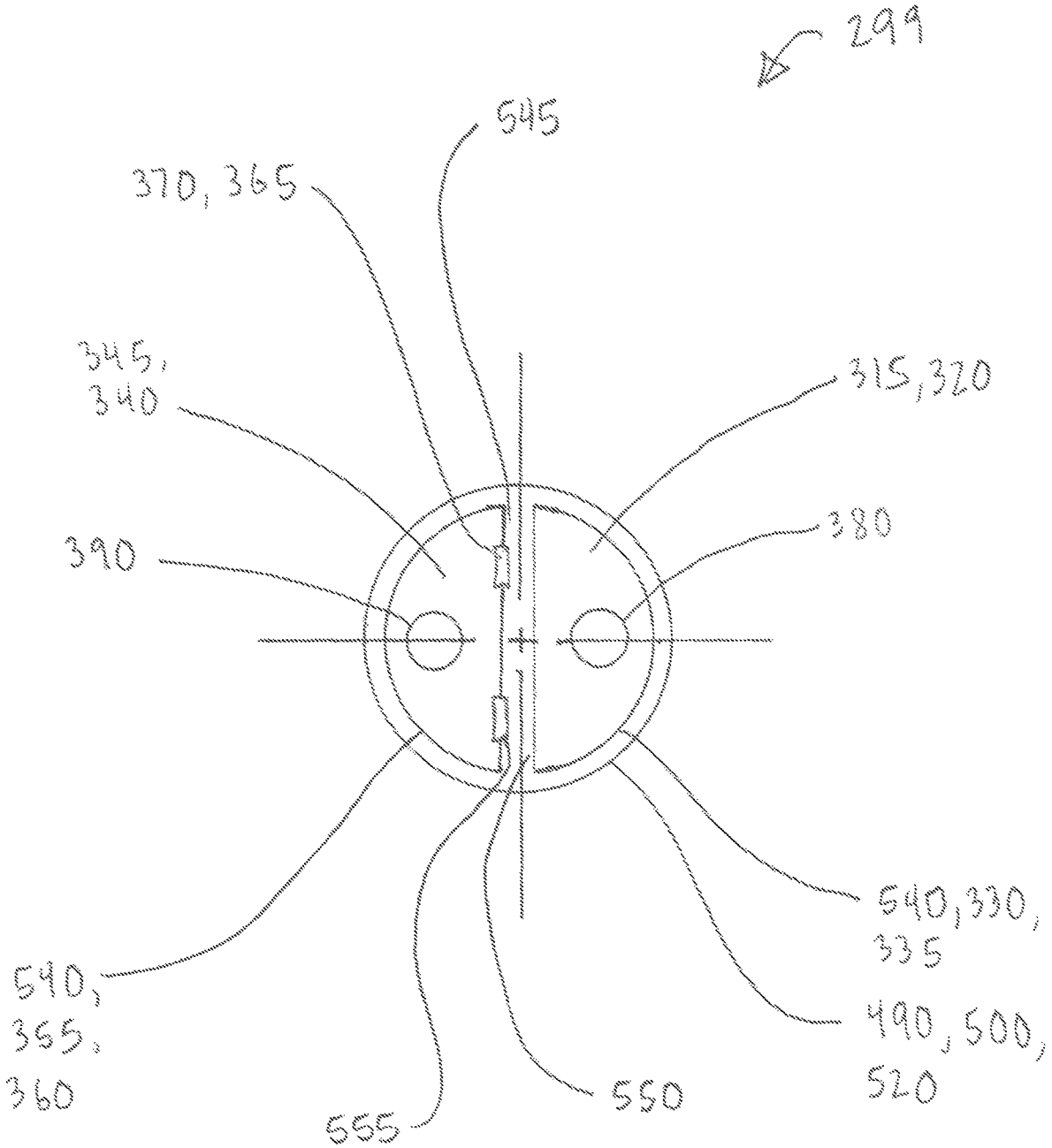

Further, FIG. 3 shows plan view 3-3 from FIG. 1, wherein FIG. 3 shows in particular the first 315 and second 340 lid apparatus both in the closed operational state that includes the hinge 365, and the first 380 and second 390 removably engagable covers.

Figure 4:
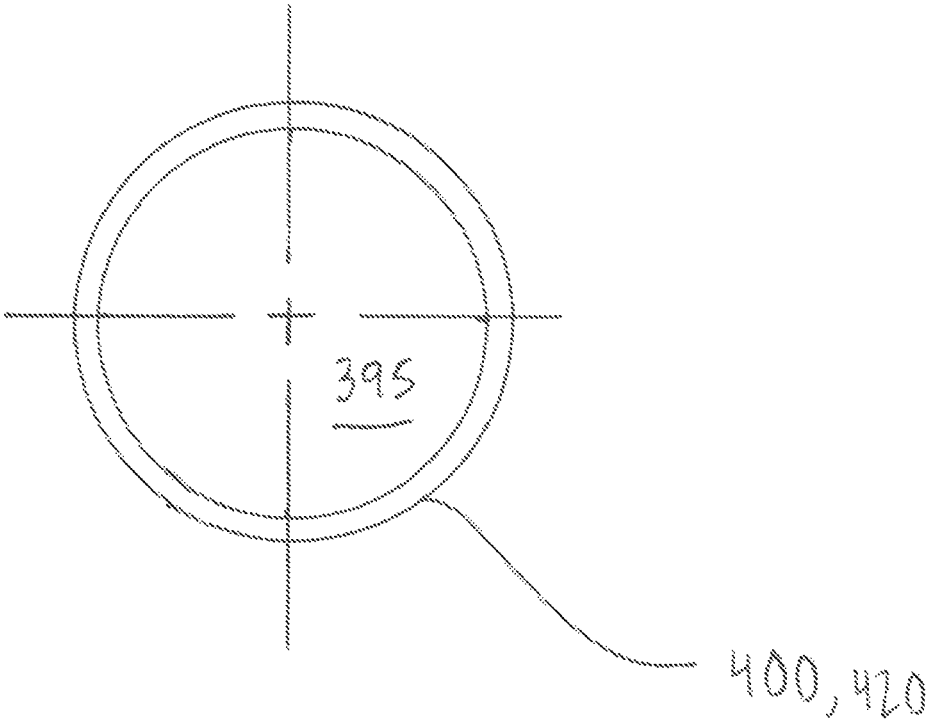

Continuing, FIG. 4 shows plan view 4-4 from FIG. 1, wherein FIG. 4 shows the primary base 395 and primary surrounding sidewall 400.

Figure 5:
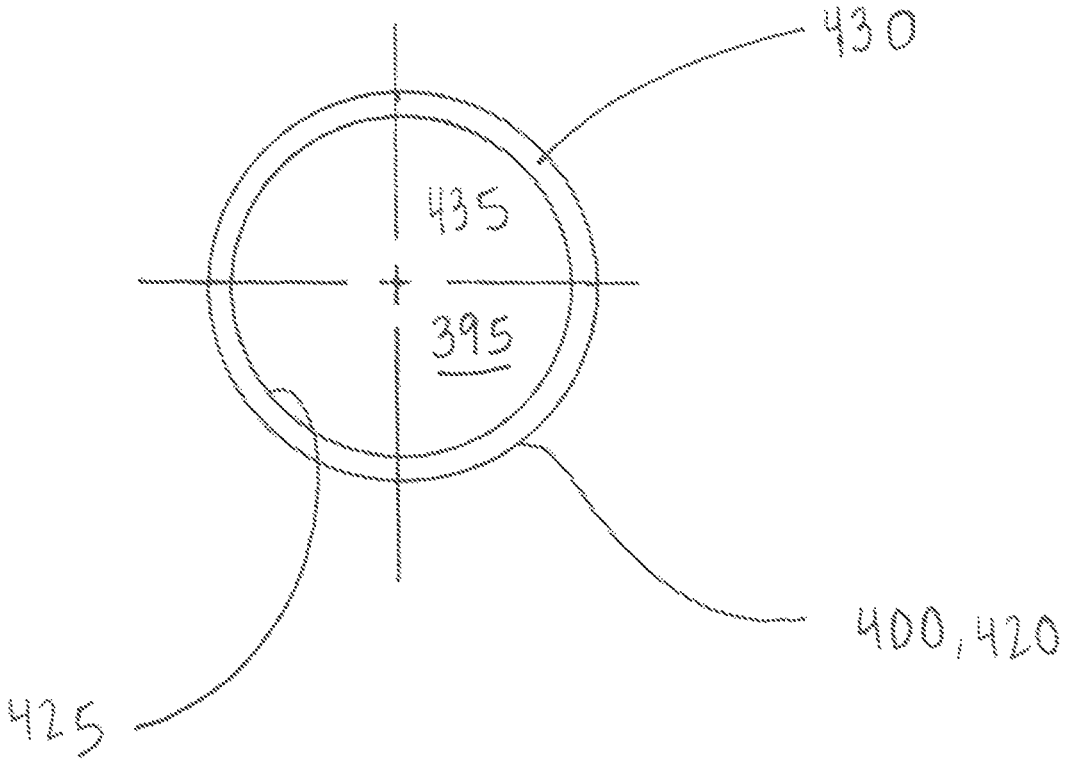

Next, FIG. 5 shows section view 5-5 from FIG. 1, wherein FIG. 5 shows the primary base 395, the primary surrounding sidewall 400, the primary interior 435, plus the inner 425 and outer 420 surfaces of the primary surrounding sidewall 400.

Figure 6:
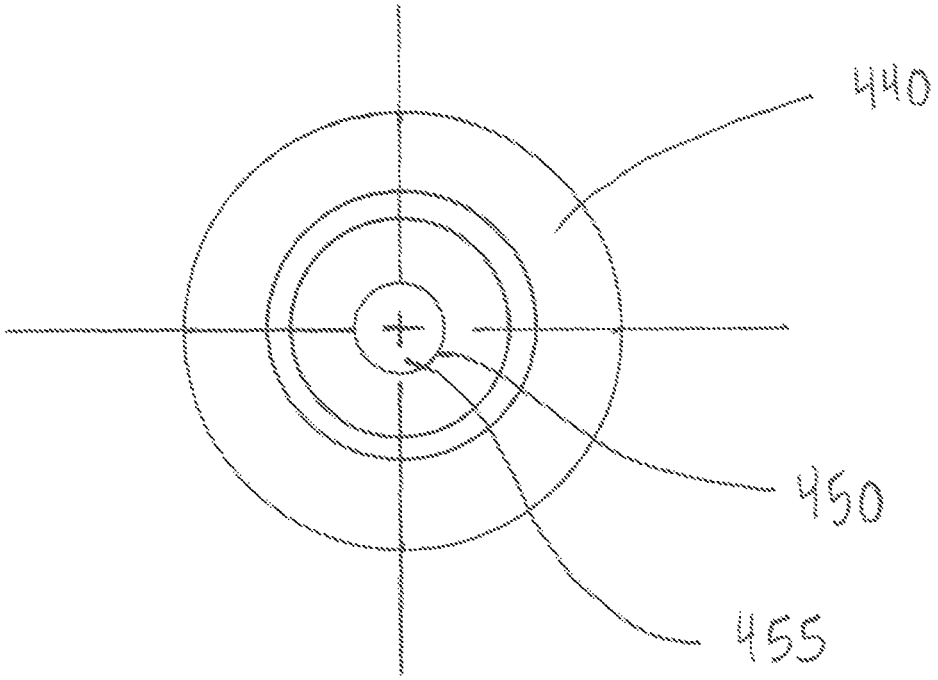

Moving onward, FIG. 6 shows section view 6-6 from FIG. 1, wherein FIG. 6 shows the primary cap 440, the primary cap aperture 450, and the primary cap 440 plug 455.

Figure 7:
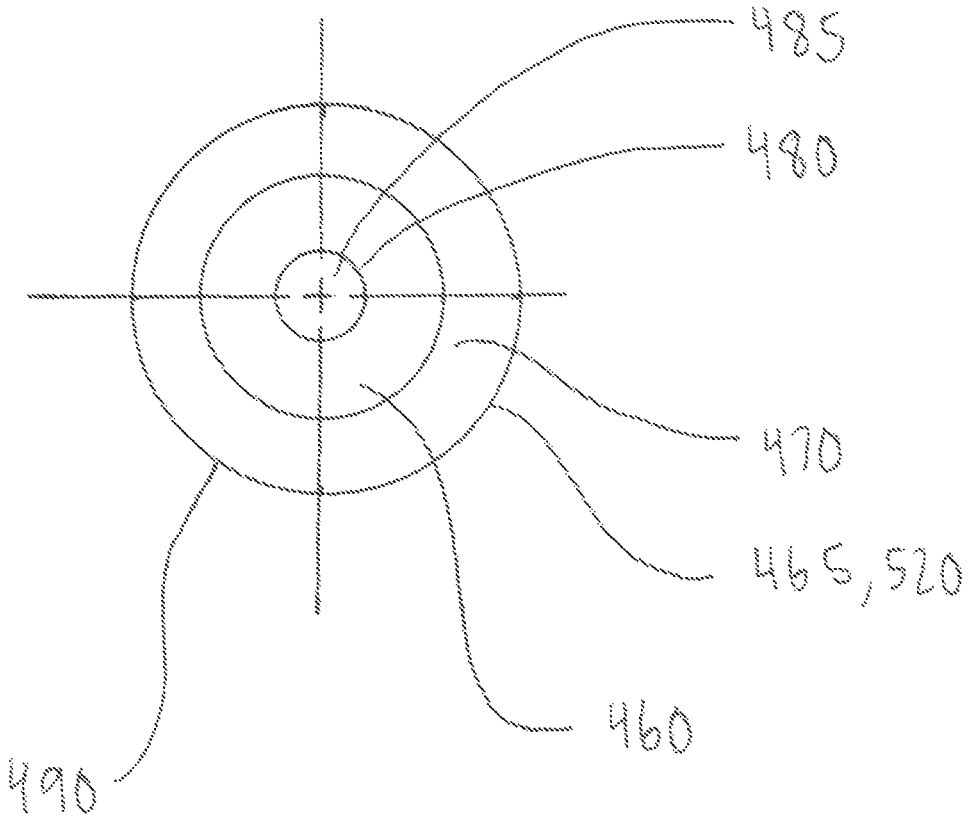

Continuing, FIG. 7 shows section view 7-7 from FIG. 1, wherein FIG. 7 shows the secondary surrounding sidewall 490, the secondary base 460, the secondary base aperture 480, and the secondary base plug 485.

Figure 8:
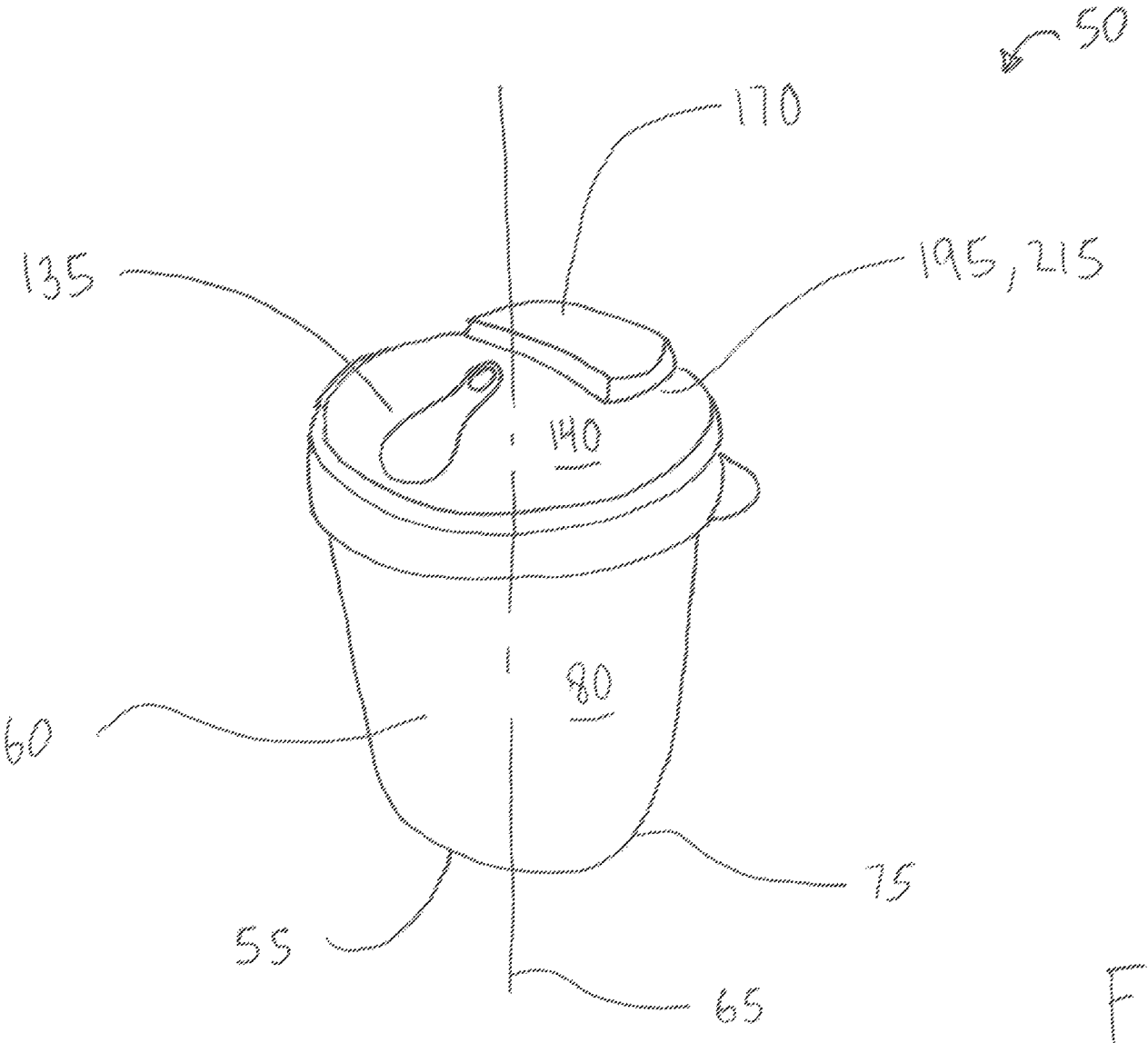
FIG. 8 shows an upper perspective view of the segmented longwise volume container apparatus that includes the surrounding sidewall, the lid apparatus, and the first sealing element in the closed operational state.

Further, FIG. 8 shows an upper perspective view of the segmented longwise volume container apparatus 50 that includes the surrounding sidewall 60, the lid apparatus 135, and the first sealing element 160 in the closed operational state.

Figure 9:
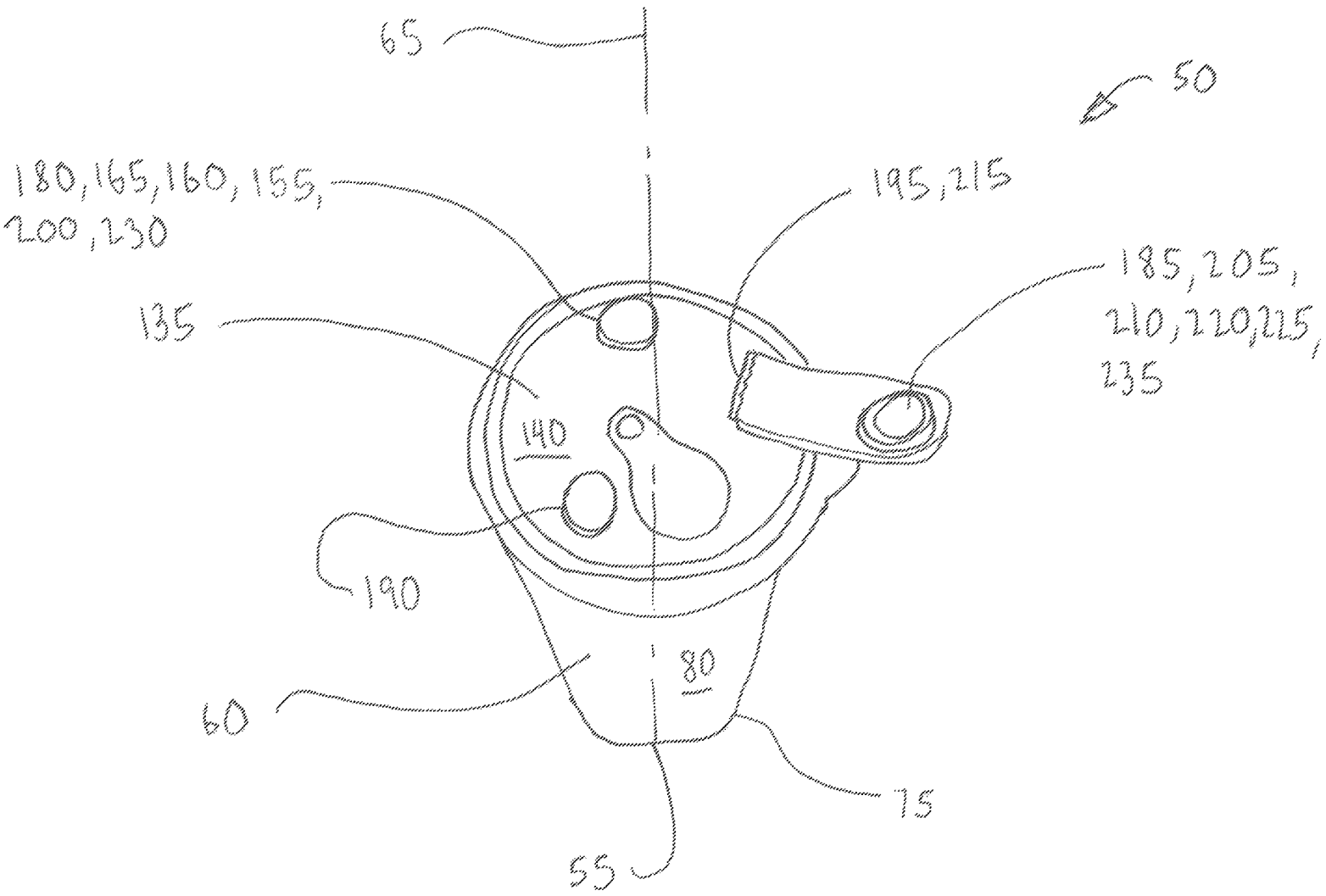
FIG. 9 shows an upper perspective view of the segmented longwise volume container apparatus that includes the surrounding sidewall, the lid apparatus, and the first sealing element in a open operational state.

In addition, FIG. 9 shows an upper perspective view of the segmented longwise volume container apparatus 50 that includes the surrounding sidewall 60, the lid apparatus 135, and the first sealing element 160 in the open operational state.

Figure 10:
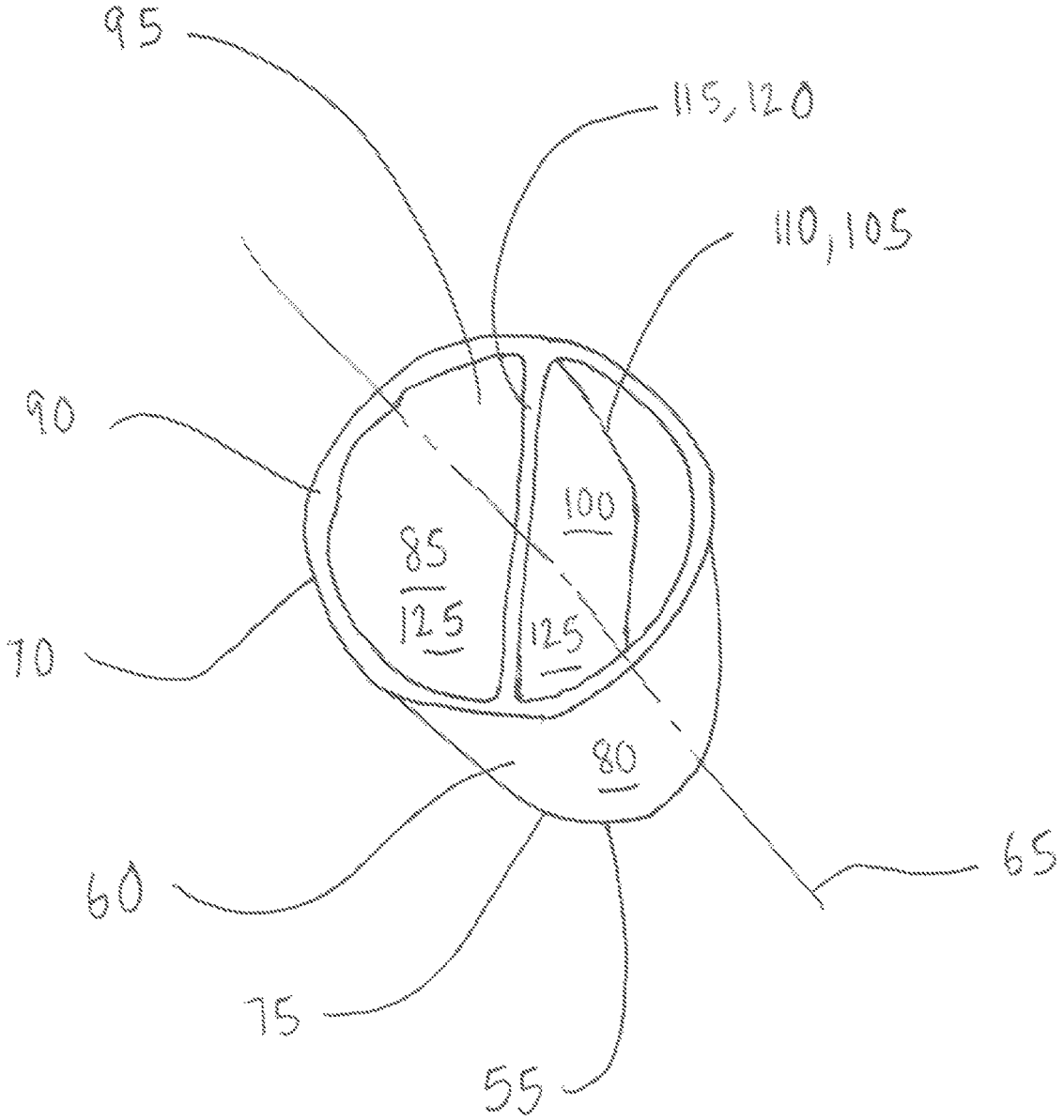
FIG. 10 shows an upper perspective view of the segmented longwise volume container apparatus that specifically shows the surrounding sidewall with the lid apparatus removed that exposes the partition, and plurality of separate volumes disposed within the surrounding sidewall.

Next, FIG. 10 shows an upper perspective view of the segmented longwise volume container apparatus 50 that specifically shows the surrounding sidewall 60 with the lid apparatus 135 removed that exposes the partition 100, and plurality of separate volumes 125 disposed within the surrounding sidewall 60.

Figure 11:
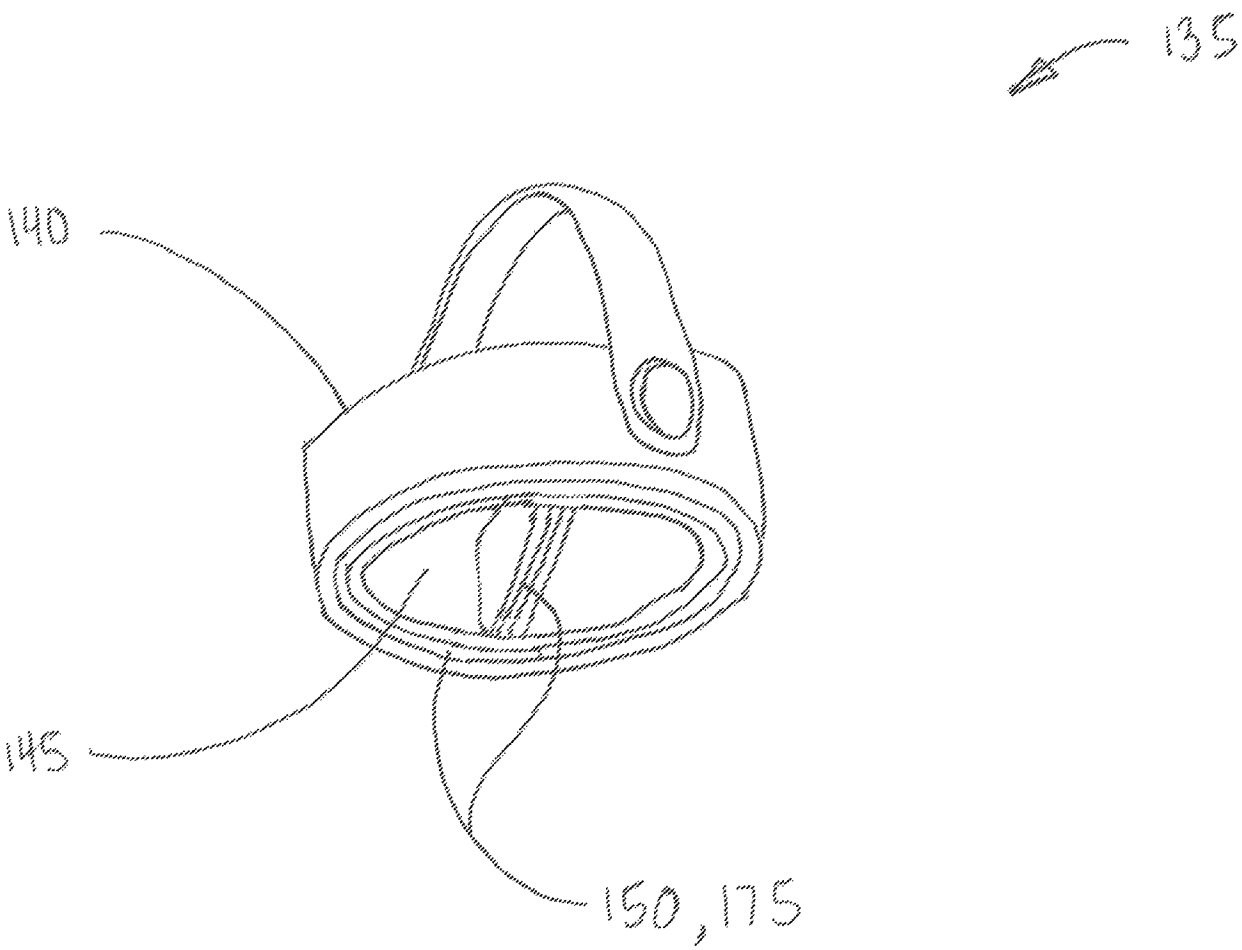
FIG. 11 shows a lower perspective view of the lid apparatus that includes the exterior and internal portions along with the removable engagement and first sealing structure.

Moving on, FIG. 11 shows a lower perspective view of the lid apparatus 135 that includes the exterior 140 and internal 145 portions along with the removable engagement 150 and first sealing structure 175.

Figure 12:
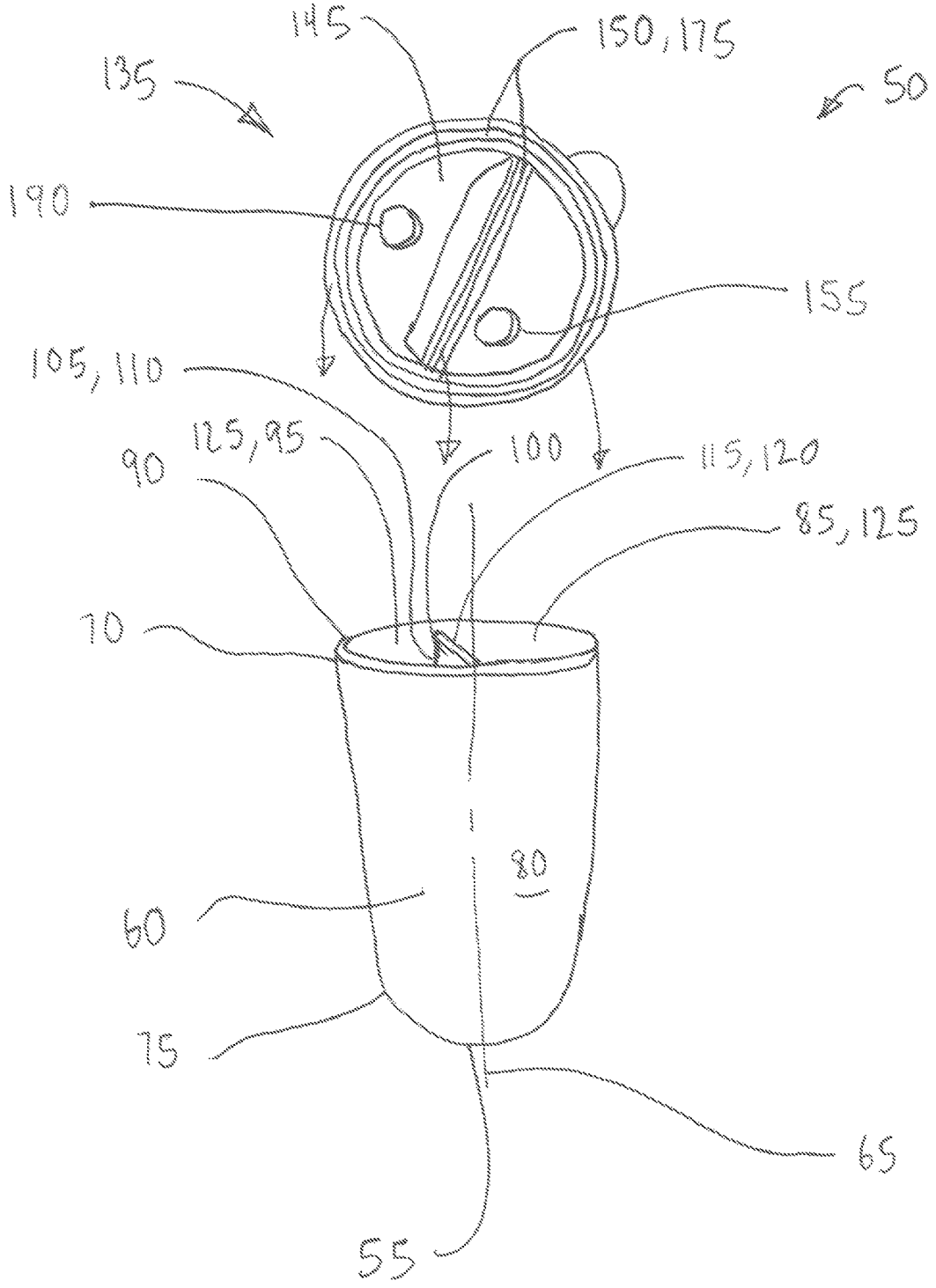
FIG. 12 shows an upper perspective view of the segmented longwise volume container apparatus that specifically shows the surrounding sidewall with the lid apparatus separated that exposes the partition, and the plurality of separate volumes disposed within the surrounding sidewall, further shown is the lower perspective view of the lid apparatus that includes the internal portion along with the removable engagement and first sealing structure, plus the first and second apertures.

Continuing, FIG. 12 shows an upper perspective view of the segmented longwise volume container apparatus 50 that specifically shows the surrounding sidewall 60 with the lid apparatus 135 separated that exposes the partition 100, and the plurality of separate volumes 125 disposed within the surrounding sidewall 60, further shown is the lower perspective view of the lid apparatus 135 that includes the internal portion 145 along with the removable engagement 150 and first sealing structure 175, plus the first 155 and second 190 apertures.

Figure 13:
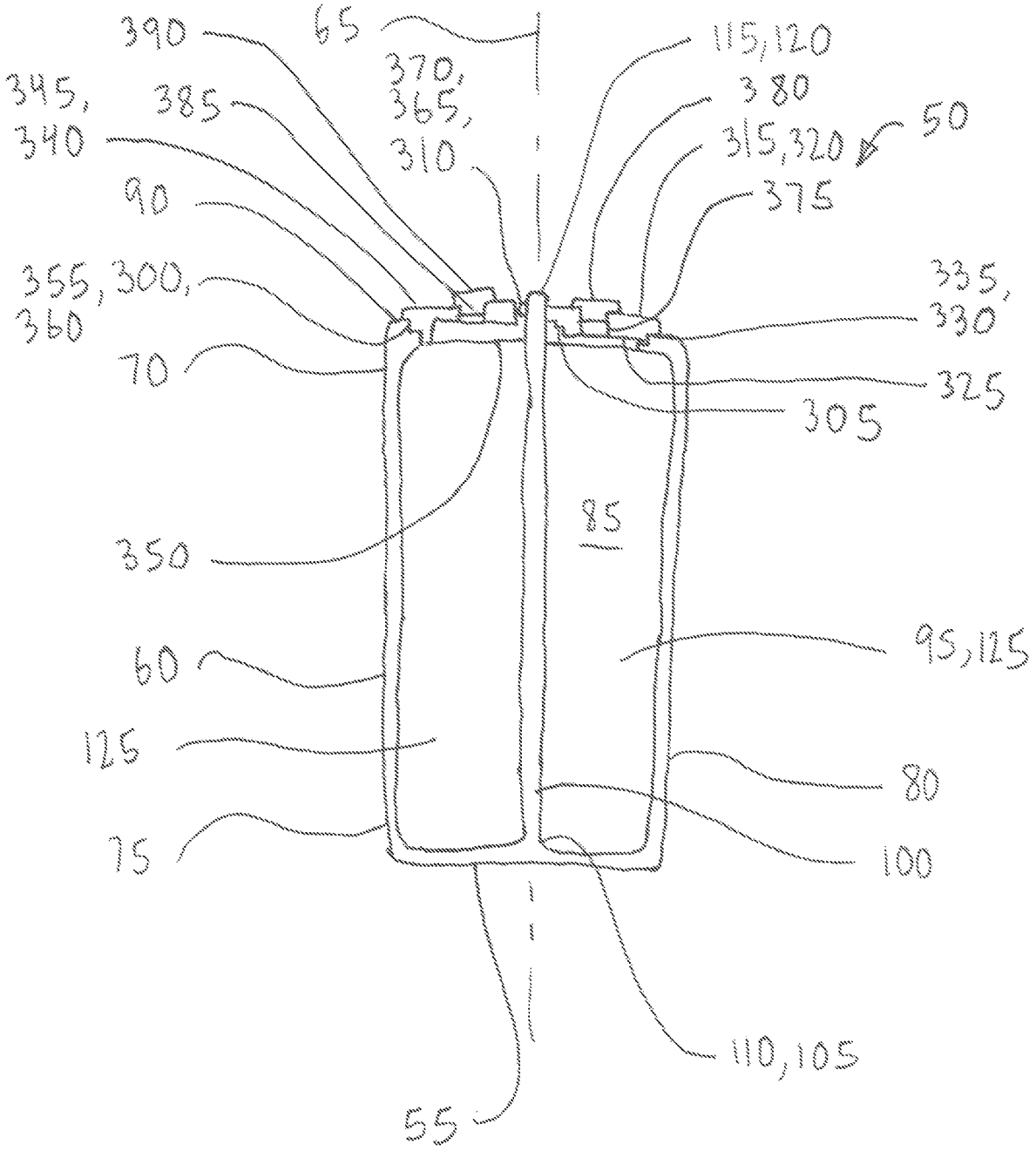
FIG. 13 shows a cross sectional view of the segmented longwise volume container apparatus that shows the surrounding sidewall with the partition, and the plurality of separate volumes disposed within the surrounding sidewall, further shown is the alternative first and second lid apparatus in the closed operational states.

Further, FIG. 13 shows a cross sectional view of the segmented longwise volume container apparatus 50 shows the surrounding sidewall 60 with the partition 100, and the plurality of separate volumes 125 disposed within the surrounding sidewall 60, further shown is the alternative first 315 and second 340 lid apparatus in the closed operational states.

Figure 14:
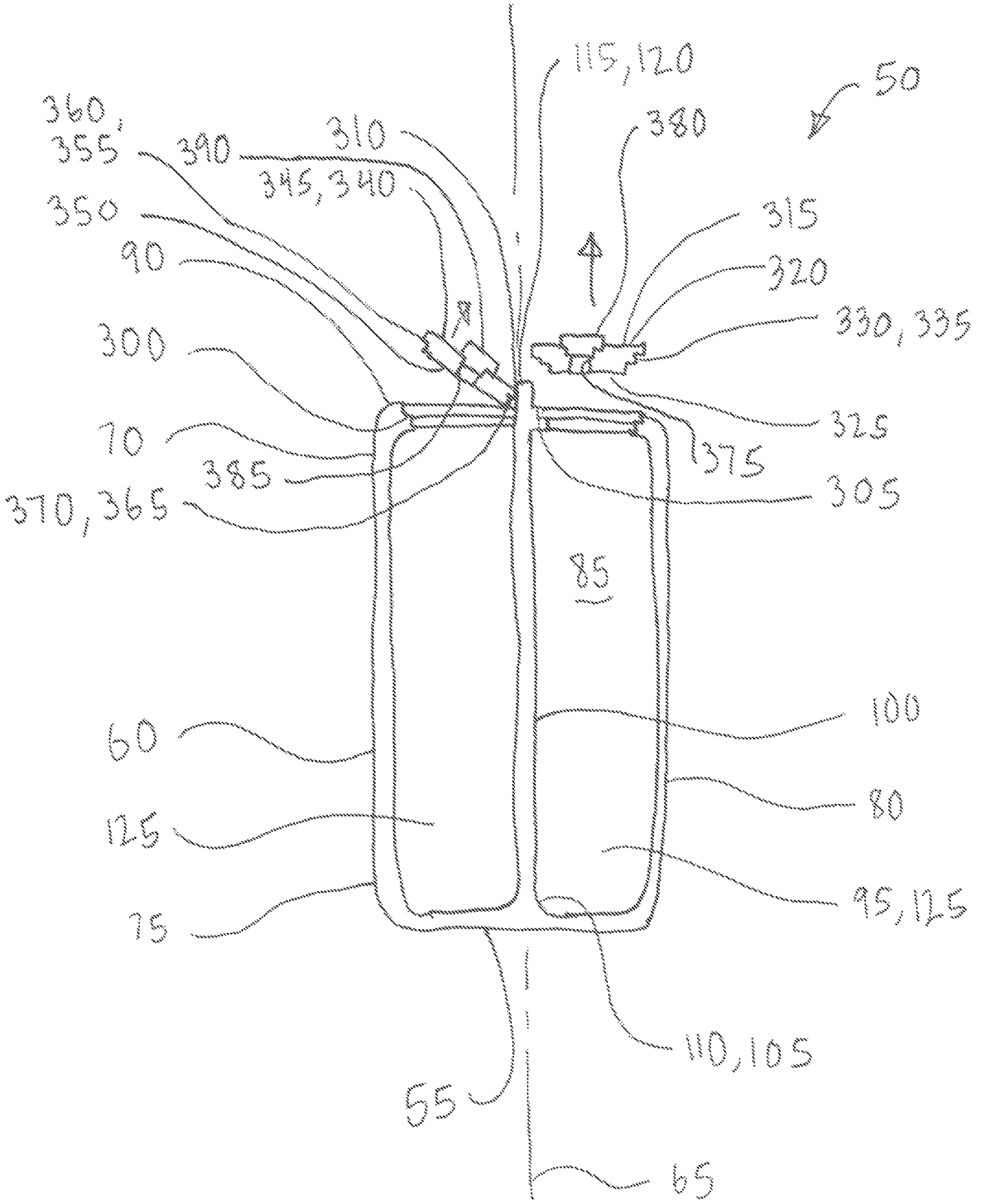
FIG. 14 shows a cross sectional view of the segmented longwise volume container apparatus shows the surrounding sidewall with the partition, and the plurality of separate volumes disposed within the surrounding sidewall, further shown is the alternative first and second lid apparatus in the open operational states.

Next, FIG. 14 shows a cross sectional view of the segmented longwise volume container apparatus 50 shows the surrounding sidewall 60 with the partition 100, and the plurality of separate volumes 125 disposed within the surrounding sidewall 60, further shown is the alternative first 315 and second 340 lid apparatus in the open operational states.

Broadly, looking at FIGS. 8 to 12, the present invention is the segmented longwise volume container apparatus 50 that includes the base 55, the surrounding sidewall 60 extending from the base 55, the surrounding sidewall 60 being about the first lengthwise axis 65, the surrounding sidewall 60 having the first end portion 70 and the opposing second end portion 75 with the first lengthwise axis 65 spanning therebetween, the surrounding sidewall 60 also including the outer surface 80 and the opposing inner surface 85, wherein the second end portion 75 is adjacent to the base 55, the surrounding sidewall 60 terminating at the first end portion 70 in the first margin 90, the base 55 and the inner surface 85 defining the surrounding sidewall interior 95.

Next in looking at FIGS. 10 and 12, the partition 100 disposed within the surrounding sidewall 60 interior 95, the partition 100 having the primary partial outer perimeter 105 that is affixed 110 to a portion of the inner surface 85, the partition 100 having the secondary partial outer perimeter 115 that extends apart from the inner surface 85 forming the secondary margin 120, wherein the partition 100 forms a plurality of separate volumes 125 within the surrounding sidewall interior 95.

Next, looking at FIGS. 8, 9, 11, and 12, the lid apparatus 135 including the exterior portion 140 and the opposing internal portion 145, the internal portion 145 is removably engagable 150 to the first margin 90 and the secondary margin 120, the lid apparatus 135 also including the first aperture 155 therethrough between the exterior portion 140 and the internal portion 145.

Further, looking at FIGS. 8, 9, 11, and 12, wherein the lid apparatus 135 further comprises the first sealing element 160 disposed on the exterior portion 140 adjacent to the first aperture 155, wherein the first sealing element 160 has the first open state 165 that allows communication therethrough the first aperture 155 and the first closed state 170 that operationally substantially precludes communication therethrough the first aperture 155.

Next, looking at FIGS. 10, 11, and 12, wherein the internal portion 145 that is removably engagable 150 to the first 90 and secondary 120 margins further comprises the first sealing structure 175 to substantially sealingly engage between the internal portion 145 and the first 90 and secondary 120 margins.

Continuing, looking at FIGS. 10, 11, and 12, wherein the first sealing element 160 further comprises the first retention means 180 to removably engage the first sealing element 160 in the first closed state 170.

Further, looking at FIGS. 10, 11, and 12, wherein the exterior portion 140 further comprises the second retention means 185 to removably engage the first sealing element 160 in the first closed state 170.

Moving ahead in looking at FIGS. 9 and 12, wherein the lid apparatus 135 further comprises the second aperture 190 therethrough between the exterior portion 140 and the internal portion 145, wherein positionally each of the first 155 and second 190 apertures is dedicated to communication with each one of the plurality of separate volumes 125.

Next, in looking at FIGS. 8 and 9, wherein the first sealing element 160 has a first pivotal attachment 195 to the exterior portion 140, wherein the first sealing element 160 having the first open pivotal state operationally allowing communication therethrough the first aperture 155 and the first closed pivotal state 170 that operationally substantially precludes communication therethrough the first aperture 155.

Continuing, in looking at FIGS. 8, 9, and 12, wherein the first sealing element 175 further comprises the first elastomeric element 200 that is partially received within the first aperture 155 in the first closed pivotal state 170 to operationally further substantially preclude communication therethrough the first aperture 155.

Moving onward, looking at FIGS. 8, 9, and 12, wherein the first sealing element 175 further comprises the third retention means 205 to removably engage the first sealing element 160 in the first closed pivotal state 170.

Again moving onward, looking at FIGS. 8 and 9, wherein the exterior portion further comprises the fourth retention means 210 to removably engage the first sealing element 160 in the first closed pivotal state 170.

Further, looking at FIGS. 8 and 9, wherein the first sealing element 160 has a first hinge attachment 215 to the exterior portion 140, wherein the first sealing element 160 having a first open hinged state 165 operationally allowing communication therethrough the first aperture 155 and a first closed hinged state 170 that operationally substantially precludes communication therethrough the first aperture 155.

Again, further, looking at FIGS. 8 and 9, wherein the first sealing element 160 further comprises the second elastomeric element 220 that is partially received within the first aperture 155 in the first closed hinged state 170 to operationally further substantially preclude communication therethrough the first aperture 155.

Again, further, looking at FIGS. 8 and 9, wherein the first sealing element 160 further comprises the fifth retention means 225 to removably engage the first sealing element 160 in the first closed hinged state 170.

Again, further, looking at FIGS. 8 and 9, wherein the exterior portion 140 further comprises the sixth retention means 230 to removably engage the first sealing element 160 in the first closed hinged state 170.

Looking at particular at FIGS. 13 and 14 for the segmented longwise volume container apparatus 50, includes the base 55, the surrounding sidewall 60 extending from the base 55, the surrounding sidewall 60 being about the first lengthwise axis 65, the surrounding sidewall 60 having the first end portion 70 and the opposing second end portion 75 with the first lengthwise axis 65 spanning therebetween, the surrounding sidewall 60 also including an outer surface 80 and the opposing inner surface 85, wherein the second end portion 75 is adjacent to the base 55. The base 55 and the inner surface 85 defining the surrounding sidewall 60 interior 95, the surrounding sidewall 60 terminating at the first end portion 70 in the first margin 90, wherein the first margin 90 has the sidewall 60 nesting step 300 facing inward towards the surrounding sidewall 60 interior 95.

Also, looking at particular at FIGS. 13 and 14, the partition 100 is disposed within the surrounding sidewall 60 interior 95, the partition 100 having the primary partial outer perimeter 105 that is affixed 110 to a portion of the inner surface 85, the partition 100 having the secondary partial outer perimeter 115 that extends apart from the inner surface 85 forming the secondary margin 120, wherein the secondary margin 120 has the partition nesting step 305 on one side and the partition hinge 310 on an opposing side, wherein the partition 100 forms the plurality of separate volumes 125 within the surrounding sidewall 60 interior 95.

Also, looking at particular at FIGS. 13 and 14, the first lid apparatus 315 includes the first exterior portion 320 and the opposing first internal portion 325, the first lid apparatus 315 further includes the first outer periphery portion 330 having the first nested step configuration 335 that removably engages the sidewall nesting step 300 and the partition nesting step 305, wherein the first lid apparatus 315 is operational to form the removably engagable first lid 315 on one of the plurality of separate volumes 125.

Also, looking at particular at FIGS. 13 and 14, the second lid apparatus 340 including the second exterior portion 345 and the opposing second internal portion 350, the second lid apparatus 340 further includes the second outer periphery portion 355, wherein a part of the second outer periphery portion 355 has the second nested step 360 that removably engages the sidewall nesting step 300 and a remaining part of the second outer periphery 355 has the second hinge 365 that is pivotally engaged 370 to the partition hinge 310, wherein the second lid apparatus 340 is operational to form a removably engagable second lid 340 on another one of the plurality of separate volumes 125.

Again, looking at particular at FIGS. 13 and 14, wherein the first lid apparatus 315 has a primary aperture 375 disposed therethrough from the first exterior portion 320 to the opposing first internal portion 325, wherein the primary aperture 375 has the first removably engagable cover 380.

Again, looking at particular at FIGS. 13 and 14, wherein the second lid apparatus 340 has the secondary aperture 385 disposed therethrough from the second exterior portion 345 to the opposing second internal portion 350, wherein the secondary aperture 385 has the second removably engagable cover 390.

Looking at FIGS. 1 to 7, the segmented shortwise volume container apparatus, includes the primary base 395, the primary surrounding sidewall 400 extending from the primary base 395, the primary surrounding sidewall 400 being about the primary lengthwise axis 405, the primary surrounding sidewall 400 having the primary first end portion 410 and the opposing primary second end portion 415 with the primary lengthwise axis 405 spanning therebetween, the primary surrounding sidewall 400 also including the primary outer surface 420 and an opposing primary inner surface 425, wherein the primary second end portion 415 is adjacent to the primary base 395, the primary base 395 and the primary inner surface 425 defining the primary surrounding sidewall interior 435, the primary surrounding sidewall 400 terminating at the primary first end portion 410 in a primary first margin 430.

Also included is the primary cap 440 having the cap outer periphery 445 that is stepped to be removably engagable to the a primary first margin 430, further the primary cap 440 having a primary cap aperture 450, further included is the primary cap aperture 450 removably engagable plug 455.

Further included is the secondary base 460 having the secondary outer periphery portion 465 that includes the secondary shoulder portion 470 that removably engages 475 the cap outer periphery 445, further the secondary base 460 including the secondary base aperture 480, that has the secondary base aperture 480 removably engagable plug 485.

Also included is the secondary surrounding sidewall 490 extending from the secondary base 460, with the secondary surrounding sidewall 490 being about the secondary lengthwise axis 495, the secondary surrounding sidewall 490 having the secondary first end portion 500 and the opposing secondary second end portion 515 with the secondary lengthwise axis 495 spanning therebetween, the secondary surrounding sidewall 490 also including the secondary outer surface 520 and the opposing secondary inner surface 525, wherein the secondary second end portion 515 is adjacent to the secondary base 460. The secondary base 460 and the secondary inner surface 525 defining the secondary surrounding sidewall interior 535, the secondary surrounding sidewall 490 terminating at the secondary first end portion 500 in the secondary first margin 530, wherein the secondary first margin 530 has the secondary sidewall nesting step 540 facing inward towards the secondary surrounding sidewall 490 interior 535.

Further included is the secondary beam 545 positioned to span across the secondary sidewall 490 nesting step 540 over the secondary surrounding sidewall 490 interior 535, wherein the secondary beam 545 has a secondary beam nesting step 550 on one side and the secondary beam hinge 555 on an opposing side.

Also included is the first lid apparatus 315 including the first exterior portion 320 and the opposing first internal portion 325, the first lid apparatus 315 further includes the first outer periphery portion 330 having the first nested step configuration 335 that removably engages the secondary sidewall nesting step 540 and the secondary beam nesting step 550, wherein the first lid apparatus 315 is operational to form a removably engagable first lid 315 on the secondary surrounding sidewall interior 535 with the secondary base aperture plug 485 sealing the secondary base aperture 480 or on the secondary surrounding sidewall interior 535 and the primary surrounding sidewall interior 435 with the secondary base plug 485 and the primary cap plug 455 both removed to allow communication between the secondary surrounding sidewall interior 535 and the primary surrounding sidewall interior 435.

Further included is the second lid apparatus 340 including the second exterior portion 345 and the opposing second internal portion 350, the second lid apparatus 340 further includes the second outer periphery portion 355, wherein a part of the second outer periphery portion 355 has the second nested step 360 that removably engages the secondary sidewall nesting step 540 and a remaining part of the second outer periphery 355 has the second hinge 365 that is pivotally engaged 370 to the secondary beam hinge 555, wherein the second lid apparatus 340 is operational to form a removably engagable second lid 340 on the secondary surrounding sidewall interior 535 with the secondary base aperture plug 485 sealing the secondary base aperture 480 or on the secondary surrounding sidewall interior 535 and the primary surrounding sidewall interior 435 with both the secondary base plug 485 and the primary cap plug 455 removed to allow communication between the secondary surrounding sidewall interior 535 and the primary surrounding sidewall interior 435.

Again, looking at particular at FIGS. 1 and 2, wherein the first lid apparatus 315 has a primary aperture 375 disposed therethrough from the first exterior portion 320 to the opposing first internal portion 325, wherein the primary aperture 375 has the first removably engagable cover 380.

Also, looking at particular at FIGS. 1 and 2, wherein the second lid apparatus 340 has the secondary aperture 385 disposed therethrough from the second exterior portion 345 to the opposing second internal portion 350, wherein the secondary aperture 385 has the second removably engagable cover 390.

CONCLUSION

Accordingly, the present invention of the segmented volume container apparatus has been described with some degree of particularity directed to the embodiments of the present invention. It should be appreciated, though; that the present invention is defined by the following claims construed in light of the prior art so modifications and changes may be made to the exemplary embodiments of the present invention without departing from the inventive concepts contained therein.

The invention claimed is:

1. A segmented shortwise volume container apparatus, comprising (a) a primary base;

(b) a primary surrounding sidewall extending from said primary base, said primary surrounding sidewall being about a primary lengthwise axis, said primary surrounding sidewall having a primary first end portion and an opposing primary second end portion with said primary lengthwise axis spanning therebetween, said primary surrounding sidewall also including a primary outer surface and an opposing primary inner surface, wherein said primary second end portion is adjacent to said primary base, said primary base and said primary inner surface defining a primary surrounding sidewall interior, said primary surrounding sidewall terminating at said primary first end portion in a primary first margin;

(c) a primary cap having a cap outer periphery that is stepped to be removably engagable to said a primary first margin, further said primary cap having a primary cap aperture;

(d) a primary cap aperture removably engagable plug;

(e) a secondary base having a secondary outer periphery portion that includes a secondary shoulder portion that removably engages said primary cap outer periphery, further said secondary base including a secondary base aperture;

(f) a secondary base aperture removably engagable plug;

(g) a secondary surrounding sidewall extending from said secondary base, said secondary surrounding sidewall being about a secondary lengthwise axis, said secondary surrounding sidewall having a secondary first end portion and an opposing secondary second end portion with said secondary lengthwise axis spanning therebetween, said secondary surrounding sidewall also including a secondary outer surface and an opposing secondary inner surface, wherein said secondary second end portion is adjacent to said secondary base, said secondary base and said secondary inner surface defining a secondary surrounding sidewall interior, said secondary surrounding sidewall terminating at said secondary first end portion in a secondary first margin, wherein said secondary first margin has a secondary sidewall nesting step facing inward towards said secondary surrounding sidewall interior;

(h) a secondary beam positioned to span across said secondary sidewall nesting step over said secondary surrounding sidewall interior, wherein said secondary beam has a secondary beam nesting step on one side and a secondary beam hinge on an opposing side;

(i) a first lid apparatus including an first exterior portion and an opposing first internal portion, said first lid apparatus further includes an first outer periphery portion having a first nested step configuration that removably engages said secondary sidewall nesting step and said secondary beam nesting step, wherein said first lid apparatus is operational to form a removably engagable first lid on said secondary surrounding sidewall interior or on said secondary surrounding sidewall interior and said primary surrounding sidewall interior; and (e) a second lid apparatus including an second exterior portion and an opposing second internal portion, said second lid apparatus further includes an second outer periphery portion, wherein a part of said second outer periphery portion has a second nested step that removably engages said secondary sidewall nesting step and a remaining part of said second outer periphery has a second hinge that is pivotally engaged to said secondary beam hinge, wherein said second lid apparatus is operational to form a removably engagable second lid on said secondary surrounding sidewall interior or on said secondary surrounding sidewall interior and said primary surrounding sidewall interior.

2. A segmented shortwise volume container apparatus according to claim 1 wherein said first lid apparatus has a primary aperture disposed therethrough from said first exterior portion to said opposing first internal portion, wherein said primary aperture has a first removably engagable cover.

3. A segmented shortwise volume container apparatus according to claim 1 wherein said second lid apparatus has a secondary aperture disposed therethrough from said second exterior portion to said opposing second internal portion, wherein said secondary aperture has a second removably engagable cover.

* * * * *